US010045117B2

(12) United States Patent
Boesen et al.

(10) Patent No.: US 10,045,117 B2
(45) Date of Patent: Aug. 7, 2018

(54) EARPIECE WITH MODIFIED AMBIENT ENVIRONMENT OVER-RIDE FUNCTION

(71) Applicant: BRAGI GmbH, München (DE)

(72) Inventors: Peter Vincent Boesen, München (DE); Darko Dragicevic, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/804,086

(22) Filed: Nov. 6, 2017

(65) Prior Publication Data

US 2018/0132032 A1 May 10, 2018

Related U.S. Application Data

(60) Provisional application No. 62/417,379, filed on Nov. 4, 2016.

(51) Int. Cl.

| | |
|---|---|
| ***G10K 11/16*** | (2006.01) |
| ***H04R 1/10*** | (2006.01) |
| ***H04R 3/00*** | (2006.01) |

(52) U.S. Cl.

CPC ..... *H04R 1/1083* (2013.01); *H04R 1/1091* (2013.01); *H04R 3/00* (2013.01); *G10K 2210/1081* (2013.01); *H04R 2430/01* (2013.01)

(58) Field of Classification Search

CPC ..... G10K 11/16

See application file for complete search history.

(56) References Cited

U.S. PATENT DOCUMENTS

| | | | |
|---|---|---|---|
| 2,325,590 | A | 8/1943 | Carlisle et al. |
| 2,430,229 | A | 11/1947 | Kelsey |
| 3,047,089 | A | 7/1962 | Zwislocki |
| D208,784 | S | 10/1967 | Sanzone |

(Continued)

FOREIGN PATENT DOCUMENTS

| | | | |
|---|---|---|---|
| CN | 204244472 | U | 4/2015 |
| CN | 104683519 | A | 6/2015 |

(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Olisa Anwah

(74) *Attorney, Agent, or Firm* — Goodhue, Coleman & Owens, P.C.

(57) ABSTRACT

An earpiece includes an earpiece housing sized and shaped to block an external auditory canal of a user, at least one microphone positioned to sense ambient sound, a speaker, and a processor disposed within the earpiece housing and operatively connected to each of the at least one microphone and the speaker, wherein the processor is configured to modify the ambient sound based on user preferences to produce modified ambient sound in a first mode of operation and to produce a second sound in response to a trigger condition. The second sound may be an unmodified version of the ambient sound. The second sound may be a modified version of the ambient sound which suppresses at least a portion of the ambient sound. The second sound may be a warning sound.

8 Claims, 5 Drawing Sheets

(56) References Cited

U.S. PATENT DOCUMENTS 3,586,794 A 6/1971 Michaelis
3,934,100 A 1/1976 Harada
3,983,336 A 9/1976 Malek et al.
4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin
8,436,780 B2 5/2013 Schantz et al.
D687,021 S 7/2013 Yuen
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker
D775,158 S 12/2016 Dong et al.
D777,710 S 1/2017 Palmborg et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov
2005/0196009 A1 9/2005 Boesen

(56) References Cited

U.S. PATENT DOCUMENTS

2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2008/0076972 A1 3/2008 Dorogusker et al.
2008/0090622 A1 4/2008 Kim et al.
2008/0146890 A1 6/2008 LeBoeuf et al.
2008/0187163 A1* 8/2008 Goldstein ..... H04R 25/70 381/380
2008/0254780 A1 10/2008 Kuhl et al.
2008/0255430 A1 10/2008 Alexandersson et al.
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran
2009/0097689 A1 4/2009 Prest et al.
2009/0105548 A1 4/2009 Bart
2009/0191920 A1 7/2009 Regen et al.
2009/0245559 A1 10/2009 Boltyenkov et al.
2009/0261114 A1 10/2009 McGuire et al.
2009/0296968 A1 12/2009 Wu et al.
2010/0033313 A1 2/2010 Keady et al.
2010/0203831 A1 8/2010 Muth
2010/0210212 A1 8/2010 Sato
2010/0320961 A1 12/2010 Castillo et al.
2011/0140844 A1 6/2011 McGuire et al.
2011/0239497 A1 10/2011 McGuire et al.
2011/0286615 A1 11/2011 Olodort et al.
2012/0057740 A1 3/2012 Rosal
2013/0316642 A1 11/2013 Newham
2013/0346168 A1 12/2013 Zhou et al.
2014/0079257 A1 3/2014 Ruwe et al.
2014/0106677 A1 4/2014 Altman
2014/0122116 A1 5/2014 Smythe
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1* 9/2014 Swanson ..... H04R 1/1016 381/74
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0036835 A1* 2/2015 Chen ..... H04R 1/1041 381/74
2015/0110587 A1 4/2015 Hori
2015/0148989 A1 5/2015 Cooper et al.
2015/0245127 A1 8/2015 Shaffer
2015/0373467 A1* 12/2015 Gelter ..... H04R 29/00 381/56
2015/0373474 A1* 12/2015 Kraft ..... H04R 1/1083 381/17
2016/0033280 A1 2/2016 Moore et al.
2016/0072558 A1 3/2016 Hirsch et al.
2016/0073189 A1 3/2016 Lindén et al.
2016/0125892 A1 5/2016 Bowen et al.
2016/0353196 A1* 12/2016 Baker ..... H04R 1/1083
2016/0360350 A1 12/2016 Watson et al.
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064437 A1 3/2017 Hviid et al.
2017/0078780 A1 3/2017 Qian et al.
2017/0078785 A1* 3/2017 Qian ..... H04R 1/1041
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0127168 A1* 5/2017 Briggs ..... H04R 1/1066
2017/0142511 A1* 5/2017 Dennis ..... H04R 1/1083
2017/0151447 A1 6/2017 Boesen
2017/0151668 A1 6/2017 Boesen
2017/0151918 A1 6/2017 Boesen
2017/0151930 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.
2017/0155993 A1 6/2017 Boesen
2017/0155997 A1 6/2017 Boesen
2017/0155998 A1 6/2017 Boesen
2017/0156000 A1 6/2017 Boesen
2017/0178631 A1 6/2017 Boesen
2017/0180842 A1* 6/2017 Boesen ..... H04R 1/1041
2017/0180843 A1 6/2017 Perianu et al.
2017/0180897 A1 6/2017 Perianu
2017/0188127 A1 6/2017 Perianu et al.
2017/0188132 A1 6/2017 Hirsch et al.
2017/0193978 A1* 7/2017 Goldman ..... G10K 11/1784
2017/0195829 A1 7/2017 Belverato et al.
2017/0208393 A1 7/2017 Boesen
2017/0214987 A1 7/2017 Boesen
2017/0215016 A1 7/2017 Dohmen et al.
2017/0230752 A1 8/2017 Dohmen et al.
2017/0257698 A1 9/2017 Boesen et al.
2017/0263236 A1* 9/2017 Boesen ..... G10K 11/1788
2017/0345408 A1* 11/2017 Hong ..... G10K 11/1788

FOREIGN PATENT DOCUMENTS

CN 104837094 A 8/2015
EP 1469659 A1 10/2004
EP 1017252 A3 5/2006
EP 2903186 A1 8/2015
GB 2074817 4/1981
GB 2508226 A 5/2014
WO 2008103925 A1 8/2008
WO 2007034371 A3 11/2008
WO 2011001433 A2 1/2011
WO 2012071127 A1 5/2012
WO 2013134956 A1 9/2013
WO 2014046602 A1 3/2014
WO 2014043179 A3 7/2014
WO 2015061633 A2 4/2015
WO 2015110577 A1 7/2015
WO 2015110587 A1 7/2015
WO 2016032990 A1 3/2016

OTHER PUBLICATIONS

Announcing the $3,333,333 Stretch Goal (Feb. 24, 2014).
Ben Coxworth: "Graphene-based ink could enable low-cost, foldable electronics", "Journal of Physical Chemistry Letters", Northwestern University, (May 22, 2013).
Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected—The personalized digital assistant", "http://bmwblog.com/2016/01/05/bmw-introduces-bmw-connected-the-personalized-digital-assistant", (Jan. 5, 2016).

(56) References Cited

OTHER PUBLICATIONS

BRAGI Is On Facebook (2014).
BRAGI Update—Arrival Of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready To Rumble, A Lot To Be Done Over Christmas (Dec. 22, 2014).
BRAGI Update—Memories From April—Update On Progress (Sep. 16, 2014).
BRAGI Update—Memories from May—Update On Progress—Sweet (Oct. 13, 2014).
BRAGI Update—Memories From One Month Before Kickstarter—Update On Progress (Jul. 10, 2014).
BRAGI Update—Memories From The First Month of Kickstarter—Update on Progress (Aug. 1, 2014).
BRAGI Update—Memories From The Second Month of Kickstarter—Update On Progress (Aug. 22, 2014).
BRAGI Update—New People @BRAGI—Prototypes (Jun. 26, 2014).
BRAGI Update—Office Tour, Tour To China, Tour to CES (Dec. 11, 2014).
BRAGI Update—Status On Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back To China, Backer Day, On Track(May 16, 2015).
BRAGI Update—Beta2 Production and Factory Line(Aug. 20, 2015).
BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview.
BRAGI Update—Status On Wireless, Supply, Timeline and Open House@BRAGI(Apr. 1, 2015).
BRAGI Update—Unpacking Video, Reviews On Audio Perform and Boy Are We Getting Close(Sep. 10, 2015).
Healthcare Risk Management Review, "Nuance updates computer-assisted physician documentation solution" (Oct. 20, 2016).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces A Health + Mobility Concept for Wellness in Mobility", Fountain Valley, Californa (2017).
International Search Report & Written Opinion, PCT/EP2016/070231 (dated Nov. 18, 2016).
Last Push Before The Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).
Wikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).

* cited by examiner

EARPIECE WITH MODIFIED AMBIENT ENVIRONMENT OVER-RIDE FUNCTION

PRIORITY STATEMENT

This application claims priority to U.S. Provisional Patent Application No. 62/417,379 filed on Nov. 4, 2016 titled Earpiece with Modified Ambient Environment Over-ride Function, all of which is hereby incorporated by reference in its entirety.

FIELD OF THE INVENTION

The present invention relates to wearable devices. More particularly, but not exclusively, the present invention relates to earpieces.

BACKGROUND

Earpieces may block all sounds from the ambient environment. In certain circumstances, however, a wearer of an earpiece may wish to hear certain sounds from the ambient environment while filtering out all other ambient sounds. Thus there is a need for a system and method of providing a user with the option of permitting one or more sounds from the user's ambient environment to be communicated without allowing other ambient sounds to reach the user's ears.

SUMMARY

Therefore, it is a primary object, feature, or advantage of the present invention to improve over the state of the art.

It is a further object, feature, or advantage of the present invention to provide one or more filtered ambient sounds in response to a user preference.

It is a still further object, feature, or advantage of the present invention to provide such filtered ambient sounds in real time.

It is another object, feature, or advantage of the present invention to provide an over-ride function to modify the ambient sound according to one or more trigger conditions.

One or more of these and/or other objects, features, or advantages of the present invention will become apparent from the specification and claims follow. No single embodiment need provide each and every object, feature, or advantage. Different embodiments may have different objects, features, or advantages. Therefore, the present invention is not to be limited to or by an objects, features, or advantages stated herein.

According to one aspect, an earpiece includes an earpiece housing sized and shaped to block an external auditory canal of a user, at least one microphone positioned to sense ambient sound, a speaker, and a processor disposed within the earpiece housing and operatively connected to each of the at least one microphone and the speaker, wherein the processor is configured to modify the ambient sound based on user preferences to produce modified ambient sound in a first mode of operation and to produce a second sound in response to a trigger condition. The second sound may be an unmodified version of the ambient sound. The second sound may be a modified version of the ambient sound which suppresses at least a portion of the ambient sound. The second sound may be a warning sound. The earpiece may further include a gestural interface operatively connected to the processor. The earpiece may further include an inertial sensor operatively connected to the processor.

According to another aspect, a method of improving audio transparency of an earpiece is provided. The method may include receiving ambient sound at a microphone of the earpiece, processing the ambient sound using a processor of the earpiece according to a user setting to produce a modified ambient sound. The method may include further processing the modified ambient sound to include a warning sound in response to a trigger condition, and producing the modified ambient sound at a speaker of the earpiece. The method may further include processing the modified ambient sound to suppress at least a portion of the ambient sound.

DETAILED DESCRIPTION

An earpiece or a set of earpieces may include an audio transparency mode of operation where the earpieces physically block the external auditory canal of a user and environmental or ambient sound is detected using one or more microphones of the earpiece and reproduced at a one or more speakers of the earpiece. Instead of reproducing the ambient sound exactly, the ambient sound may be processed by one or more processors of the earpiece to create a modified ambient sound according to one or more user preferences. An over-ride function may be performed to over-ride this functionality in one of several ways. The over-ride function may be used to cease outputting the modified ambient sound. The over-ride function may be used to further process the modified ambient sound to introduce a warning sound into the modified ambient sound. The over-ride function may be used to cease outputting the modified ambient sound and reproduce the ambient sound in an unmodified form. The over-ride function may be invoked in response to a trigger condition. The trigger condition may be any number of conditions which may be determined by a user or a manufacturer. These trigger conditions may be based on the ambient sound. For example, if the ambient sound is at a volume which exceeds a pre-set threshold, the trigger condition may be met. These trigger conditions may be based on other sensor information such as biometric or physiological information sensed with one or more biometric sensors of the earpiece or motion data sensed with an inertial sensor of the earpiece. For example, if movement of the user exceeds a certain speed, the trigger condition may be met.

Figure 1:
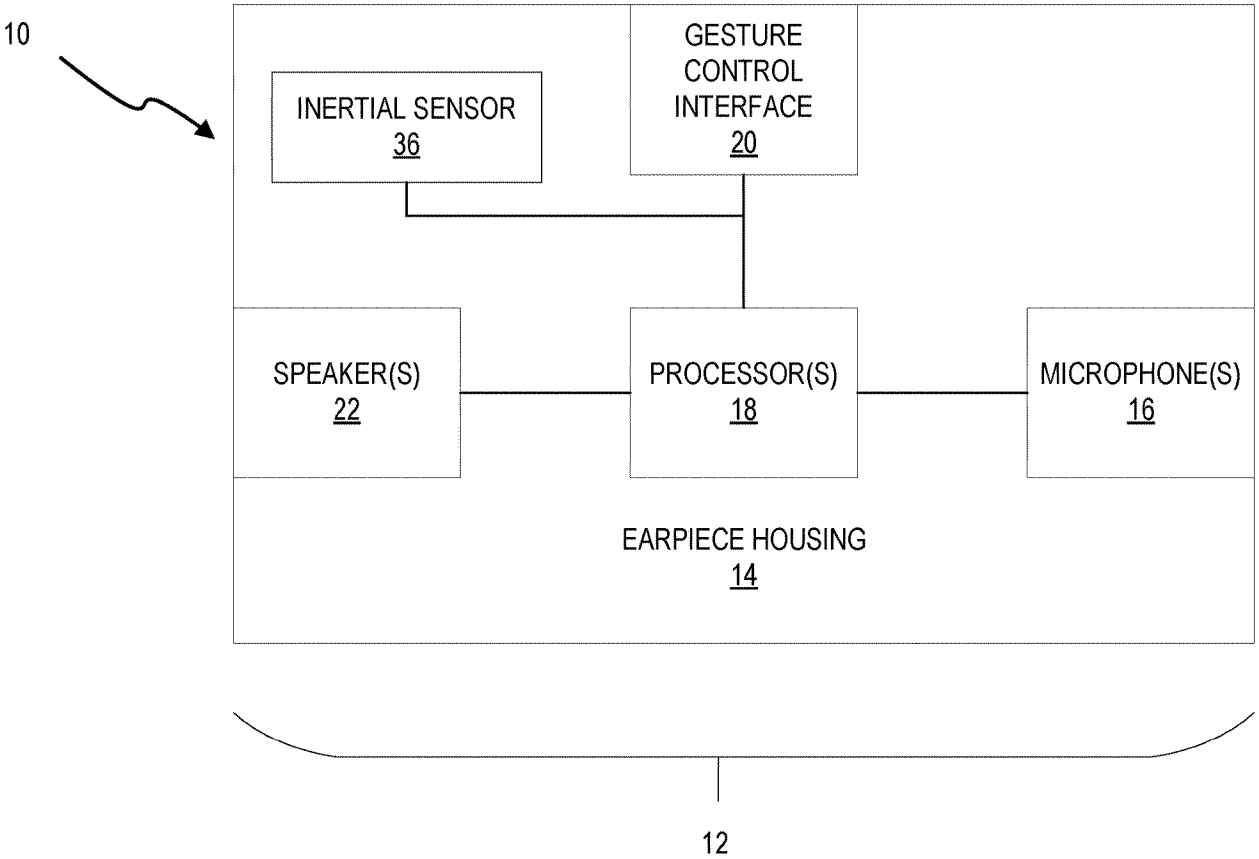
FIG. 1 includes a block diagram of one embodiment of the system.

FIG. 1 illustrates a block diagram of the system 10 having at least one earpiece 12 having an earpiece housing 14. A microphone 16 is positioned to receive ambient sound. One or more processors 18 may be disposed within the earpiece housing 14 and operatively connected to microphone 16. A gesture control interface 20 is operatively connected to the processor 18. The gesture control interface 20 configured to allow a user to control the processing of the ambient sounds. An inertial sensor 36 is also shown which is operatively connected to the one or more processors. One or more speakers 22 may be positioned within the earpiece housing 14 and configured to communicate the ambient sounds desired by the user. The earpiece housing 14 may be composed of soundproof materials to improve audio transparency or any material resistant to shear and strain and may also have a sheath attached in order to improve comfort, sound transmission or reduce the likelihood of skin or ear allergies. In addition, the earpiece housing 14 may also substantially encompass the external auditory canal of the user in order to substantially reduce or eliminate external sounds to further improve audio transparency. The housing 14 of each wearable earpiece 12 may be composed of any material or combination of materials, such as metals, metal alloys, plastics, or other polymers having substantial deformation resistance One or more microphones 16 may be positioned to receive one or more ambient sounds. The ambient sounds may originate from the user, a third party, a machine, an animal, another earpiece, another electronic device or even nature itself. The types of ambient sounds received by the microphones 16 may include words, combination of words, sounds, combinations of sounds or any combination of the aforementioned. The ambient sounds may be of any frequency and need not necessarily be audible to the user.

The processor 18 is the logic controls for the operation and functionality of the earpiece(s) 12. The processor 18 may include circuitry, chips, and other digital logic. The processor 18 may also include programs, scripts and instructions, which may be implemented to operate the processor 18. The processor 18 may represent hardware, software, firmware or any combination thereof. In one embodiment, the processor 18 may include one or more processors. The processor 18 may also represent an application specific integrated circuit (ASIC), system-on-a-chip (SOC) or field programmable gate array (FPGA).

The processor 18 may also process gestures to determine commands or selections implemented by the earpiece 12. Gestures such as taps, double taps, triple taps, swipes, or holds may be used. The processor 18 may also process movements by the inertial sensor 36. The inertial sensor 36 may be a 9-axis inertial sensor which may include a 3-axis accelerometer, 3-axis gyroscope, and 3-axis magnetometer. The inertial sensor 36 may serve as a user interface. For example, a user may move their head and the inertial sensor may detect the head movements.

In one embodiment, the processor 18 is circuitry or logic enabled to control execution of a set of instructions. The processor 18 may be one or more microprocessors, digital signal processors, application-specific integrated circuits (ASIC), central processing units or other devices suitable for controlling an electronic device including one or more hardware and software elements, executing software, instructions, programs, and applications, converting and processing signals and information and performing other related tasks. The processor may be a single chip or integrated with other computing or communications components.

Figure 2:
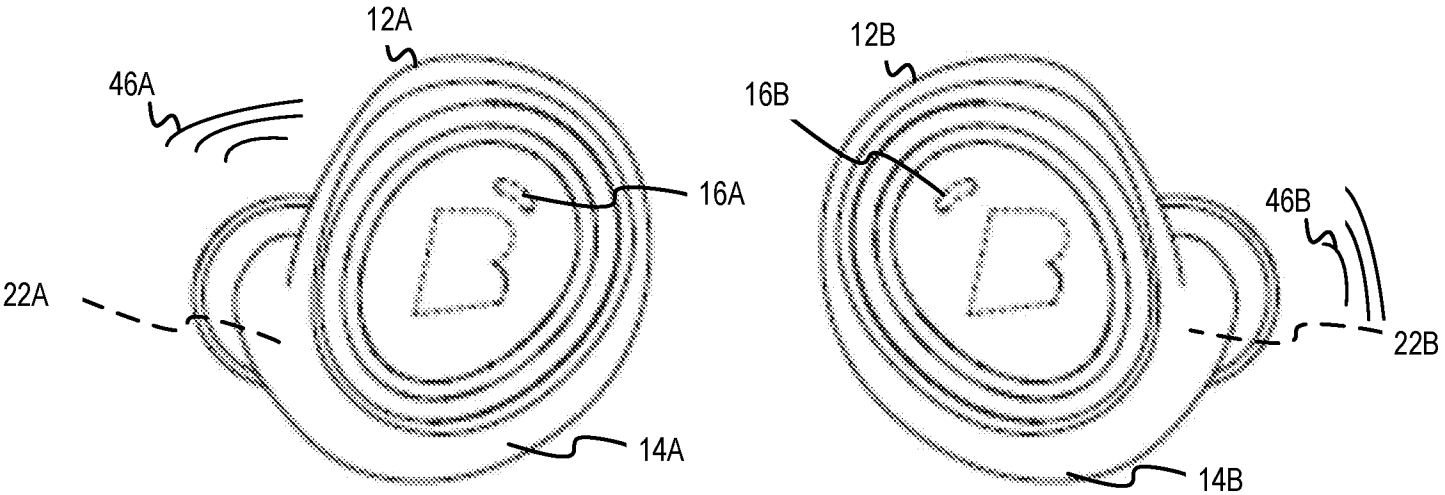
FIG. 2 illustrates a system that includes a left earpiece and a right earpiece.
Figure 3:
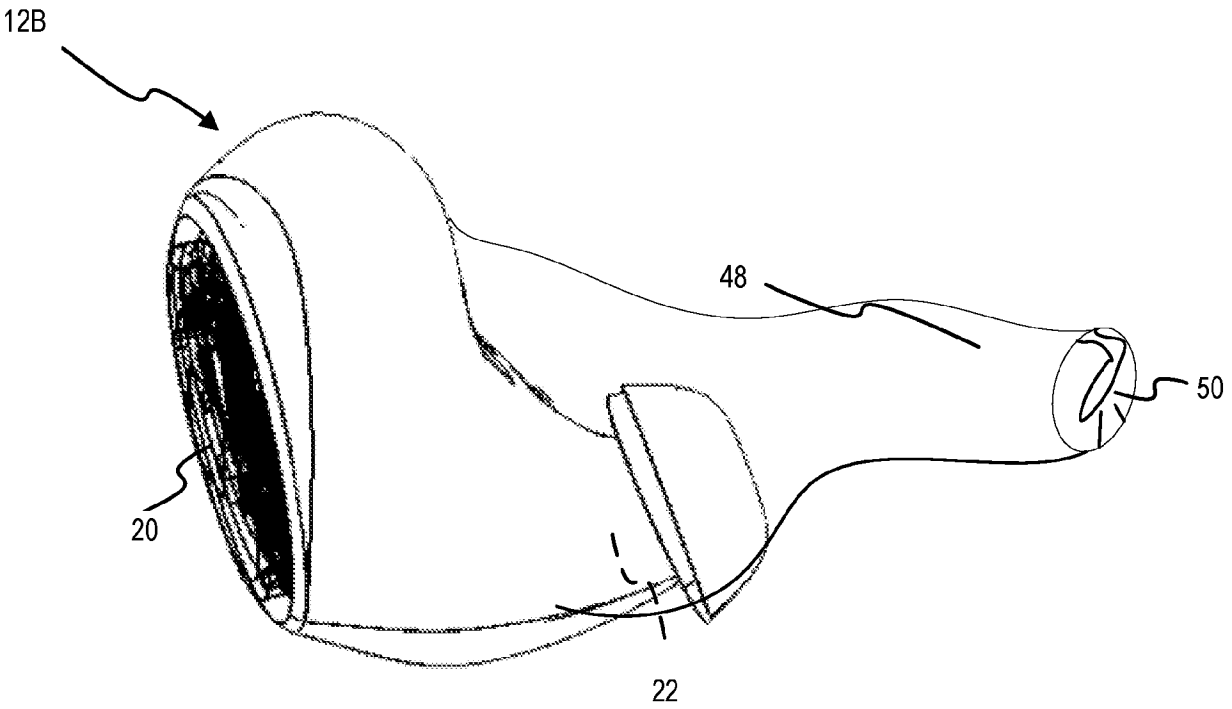
FIG. 3 illustrates a right earpiece and its relationship to an ear.
Figure 4:
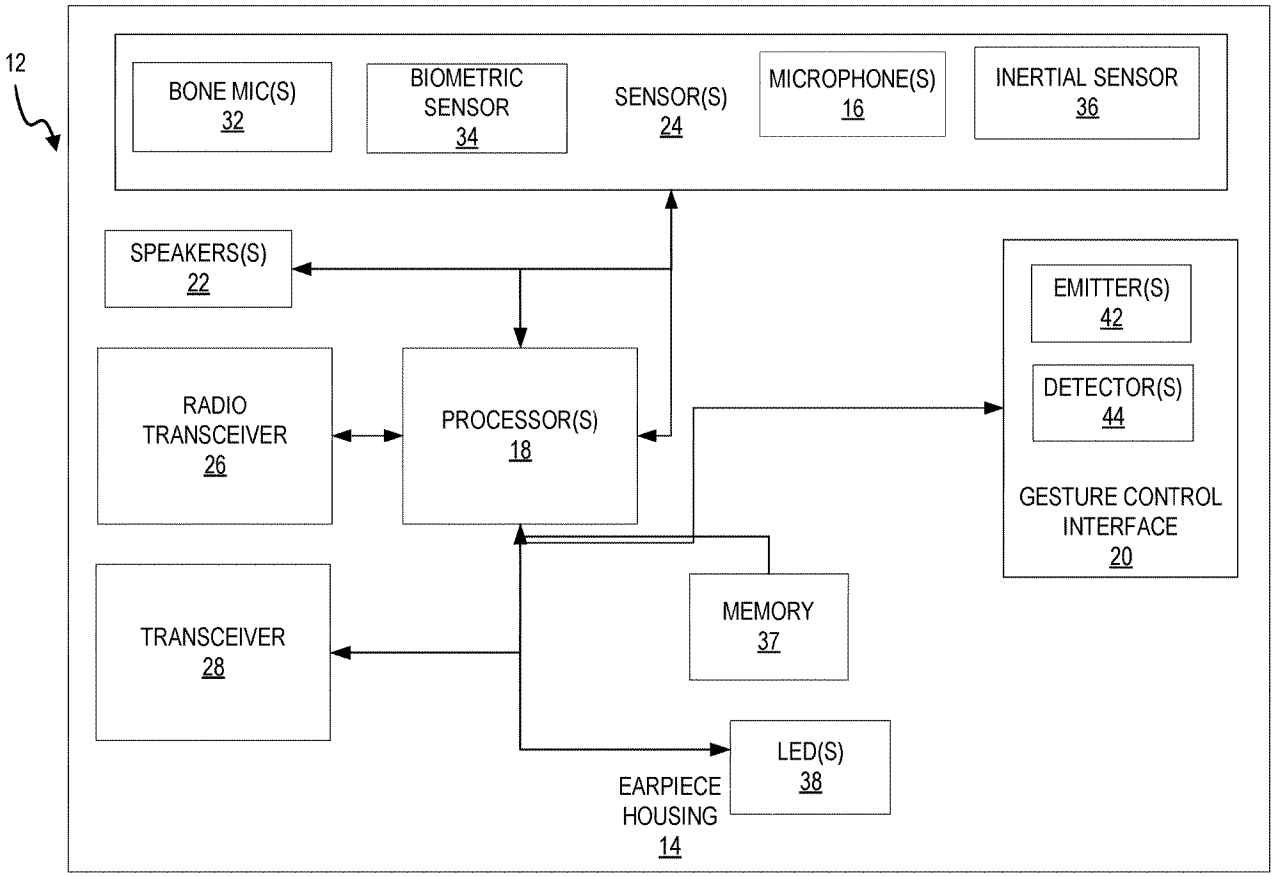
FIG. 4 includes a block diagram of a second embodiment of the system.

A gesture control interface 20 is mounted onto the earpiece housing 14 and operatively connected to the processor 18 and configured to allow a user to select one or more sound sources using a gesture. The gesture control interface 20 may be located anywhere on the earpiece housing 14 conducive to receiving a gesture and may be configured to receive tapping gestures, swiping gestures, or gestures which do not make contact with either the gesture control interface 20 or another part of the earpiece 12. FIG. 2 illustrates a pair of earpieces which includes a left earpiece 12A and a right earpiece 12B. The left earpiece 12A has a left earpiece housing 14A. The right earpiece 12B has a right earpiece housing 14B. A microphone 16A is shown on the left earpiece 12A and a microphone 16B is shown on the right earpiece 12B. The microphones 16A and 16B may be positioned to receive ambient sounds. Additional microphones may also be present. Speakers 22A and 22B are configured to communicate modified sounds 46A and 46B after processing. The modified sounds 46A and 46B may be communicated to the user FIG. 3 illustrates a side view of the right earpiece 12B and its relationship to a user's ear. The right earpiece 12B may be configured to isolate the user's ear canal 48 from the environment so that the user does not hear the environment directly, but may hear a reproduction of the environmental sounds as modified by the earpiece 12B which is directed towards the tympanic membrane 50 of the user. There is a gesture control interface 20 shown on the exterior of the earpiece. FIG. 4 is a block diagram of an earpiece 12 having an earpiece housing 14, and a plurality of sensors 24 operatively connected to one or more processors 18. The one or more sensors may include one or more bone microphones 32 which may be used for detecting speech of a user. The sensors 24 may further include one or more biometric sensors 34 which may be used for monitoring physiological conditions of a user. The sensors 24 may include one or more microphones 16 which may be used for detecting sound within the ambient environment of the user. The sensors 24 may include one or more inertial sensors 36 which may be used for determining movement of the user such as head motion of the user which may be used to receive selections or instructions from a user. A gesture control interface 20 is also operatively connected to the one or more processors 18. The gesture control interface 20 may be implemented in various ways including through capacitive touch or through optical sensing. The gesture control interface 20 may include one or more emitters 42 and one or more detectors 44. Thus, for example, in one embodiment, light may be emitted at the one or more emitters 42 and detected at the one or more detectors 44 and interpreted to indicate one or more gestures being performed by a user. One or more speakers 22 are also operatively connected to the processor 18. A radio transceiver 26 may be operatively connected to the one or more processors 18. The radio transceiver may be a BLUETOOTH transceiver, a BLE transceiver, a Wi-Fi transceiver, or other type of radio transceiver. A transceiver 28 may also be present. The transceiver 28 may be a magnetic induction transceiver such as a near field magnetic induction (NFMI) transceiver. Where multiple earpieces are present, the transceiver 28 may be used to communicate between the left and the right earpieces. A memory 37 is operatively connected to the processor and may be used to store instructions regarding sound processing, user settings regarding selections, or other information. One or more LEDs 38 may also be operatively connected to the one or more processors 18 and may be used to provide visual feedback regarding operations of the wireless earpiece.

Figure 5:
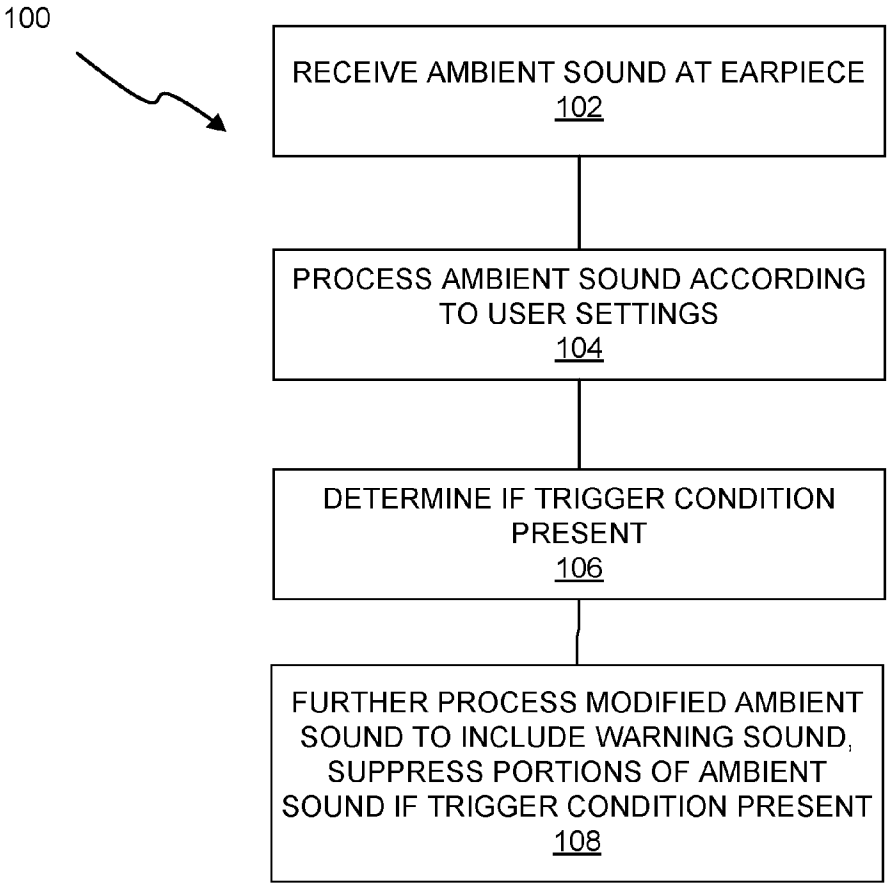
FIG. 5 includes a flowchart of one implementation of the method.

FIG. 5 illustrates one example of a method 100. In step 102 ambient sound is detected or received at one or more microphones of an earpiece. In step 104, the ambient sound is processed according to user settings. The user settings may provide for amplifying the ambient sound, filtering out sound of particular frequencies, filtering out sound of particular types, changing the frequency of the sound, or otherwise modifying the ambient sound. The user may specify the settings in various ways including through voice command, use of the gestural interface, use of the inertial sensor, or through other electronic devices in operative communication with the earpiece. For example, a software application may operate on a mobile device in operative communication with the wireless earpiece which allows the user to specify the settings. The settings may be stored in a non-transitory machine readable storage medium of the earpiece. Next in step 106, a determination is made as to whether the trigger condition is present. The trigger condition may be specified in the same manner as the user settings. The trigger condition may also be provided as a manufacturer setting as well. The trigger condition may be a parameter of the ambient sound, of the modified ambient sound, or a condition associated with user movement data sensed with an inertial sensor, physiological parameters sensed with a biometric sensor or other type of trigger condition. Examples of trigger conditions may include sound which exceeds both a pre-set intensity and a pre-set frequency, sound which exceeds a pre-set intensity, sound which exceeds a pre-set frequency, movement which exceeds a pre-set velocity, movement which exceeds a pre-set acceleration, heart rate which exceeds a pre-set heart rate, or other type of trigger condition. If the trigger condition is present, then step 108 further processing of the modified ambient sound may be performed. The further processing may be to include a warning sound within the modified ambient sound. This may be in the form of a tone, a voice warning, or other sound. The further processing may be to suppress portions of the ambient sound. For example, where the trigger is associated with the sound exceeding a pre-set intensity and/or frequency, the further processing may be to suppress the high-frequency tone or the intensity or both. Next the modified ambient sound as further modified to suppress portions thereof or to include a warning sound may be reproduced at one or more speakers of the earpiece.

Therefore, various methods, systems, and apparatus have been shown and described. Although various embodiments or examples have been set forth herein, it is to be understood that the present invention contemplates numerous options, variations, and alternatives as may be appropriate in a particular application or environment.

What is claimed is:

1. An earpiece comprising:

an earpiece housing sized and shaped to block an external auditory canal of a user;

at least one microphone positioned to sense ambient sound;

an inertial sensor;

a speaker; and a processor disposed within the earpiece housing and operatively connected to each of the at least one microphone, the inertial sensor, and the speaker, wherein the processor is configured to modify the ambient sound based on user preferences to produce modified ambient sound in a first mode of operation and to produce a warning sound in response to a trigger condition, the trigger condition based on movement sensed with the inertial sensor that exceeds a threshold.

2. The earpiece of claim 1 wherein the warning sound is an unmodified version of the ambient sound.

3. The earpiece of claim 1 wherein the warning sound is a modified version of the ambient sound which suppresses at least a portion of the ambient sound.

4. The earpiece of claim 1 further comprising a gestural interface operatively connected to the processor.

5. A method of improving audio transparency of an earpiece comprising:

receiving ambient sound at a microphone of the earpiece;

processing the ambient sound using a processor of the earpiece according to a user setting to produce a modified ambient sound;

further processing the modified ambient sound to include a warning sound in response to a trigger condition, wherein the trigger condition is met when a parameter sensed with an inertial sensor of the earpiece exceeds a threshold; and producing the modified ambient sound at a speaker of the earpiece.

6. The method of claim 5 further comprising further processing the modified ambient sound to suppress at least a portion of the ambient sound.

7. An earpiece comprising:

an earpiece housing sized and shaped to block an external auditory canal of a user;

at least one microphone positioned to sense ambient sound;

a biometric sensor;

a speaker; and a processor disposed within the earpiece housing and operatively connected to each of the at least one microphone, the biometric sensor, and the speaker, wherein the processor is configured to modify the ambient sound based on user preferences to produce modified ambient sound in a first mode of operation and to produce a second sound in response to a trigger condition, the trigger condition based on a biometric parameter sensed with the biometric sensor.

8. A method of improving audio transparency of an earpiece comprising:

receiving ambient sound at a microphone of the earpiece;

processing the ambient sound using a processor of the earpiece according to a user setting to produce a modified ambient sound;

further processing the modified ambient sound to include a warning sound in response to a trigger condition, wherein the trigger condition is met when a physiological parameter sensed with a biometric sensor of the earpiece exceeds a threshold; and producing the modified ambient sound at a speaker of the earpiece.

* * * * *